US005306160A

United States Patent [19]

Roberts

[11] Patent Number: 5,306,160

[45] Date of Patent: Apr. 26, 1994

[54] SELF-ALIGNING HIGH-DENSITY PRINTED CIRCUIT CONNECTOR

[75] Inventor: Joseph A. Roberts, Grafton, N.H.

[73] Assignee: Rock Ltd. Partnership, Grafton, N.H.

[21] Appl. No.: 37,351

[22] Filed: Mar. 26, 1993

Related U.S. Application Data

[63] Continuation-in-part of Ser. No. 861,119, Mar. 31, 1992, Pat. No. 5,240,420.

[51] Int. Cl.[5] ..... H01R 9/09

[52] U.S. Cl. ..... 439/62; 439/67; 439/77; 439/493

[58] Field of Search ..... 439/59, 62, 69, 77, 439/260, 492, 493, 495, 499, 629, 630, 632–634, 636

[56] References Cited

U.S. PATENT DOCUMENTS

| | | |
|---|---|---|
| 3,941,448 | 3/1976 | Evans . |
| 4,172,626 | 10/1979 | Olsson . |
| 4,225,205 | 9/1980 | Sinclair et al. . |
| 4,227,767 | 10/1980 | Mouissie . |
| 4,509,098 | 4/1985 | DasGupta et al. . |
| 4,509,099 | 4/1985 | Takamatsu et al. . |
| 4,531,793 | 7/1985 | Hochgesang . |
| 4,581,495 | 4/1986 | Geri et al. . |
| 4,583,800 | 4/1986 | Roberts et al. . |
| 4,587,596 | 5/1986 | Bunnell . |
| 4,597,617 | 7/1986 | Enochs . |
| 4,602,317 | 7/1986 | Rovnyak et al. . |
| 4,621,305 | 11/1986 | Daum . |
| 4,740,867 | 4/1988 | Roberts et al. . |
| 4,969,824 | 11/1990 | Casciotti . |
| 5,080,595 | 1/1992 | Mouissie . |
| 5,240,420 | 8/1993 | Roberts ..... 439/62 |

OTHER PUBLICATIONS

IBM Corp., Cable Connector, IBM Tech. Disc. Bull. vol. 28 #11, Apr. 1986, pp. 4989 & 4990.

Rice et al., Circuit Board Assembly, IBM Tech. Disc. Bull., vol. 4, #9, Feb. 1962, p. 7.

*Primary Examiner*—Paula A. Bradley

*Attorney, Agent, or Firm*—Davis, Bujold & Streck

[57] ABSTRACT

A connector for electrically conductive connection to electrically conductive contact pads of a circuit comprising a rigid housing; a resilient flexible circuit assembly captively housed, at least in part, in the housing and having an end portion carrying a row of conductive circuit areas on one face thereof corresponding to the row of pads; the assembly being permitted a limited desired float, so that the areas are self aligning with and are resiliently urged into electrically conductive contact with the pads when the connector is attached at a desired location to the circuit. The elements have alignment features engaging a cooperating feature of the circuit to register the areas with the pads, when the connector is attached at a desired location to the circuit, with sufficient accuracy to ensure that only the desired conductive contact between the areas and the pads is achieved.

19 Claims, 9 Drawing Sheets

FIG.19
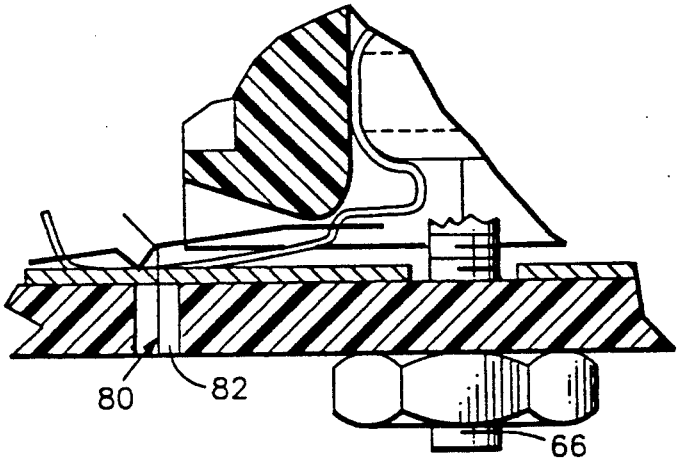
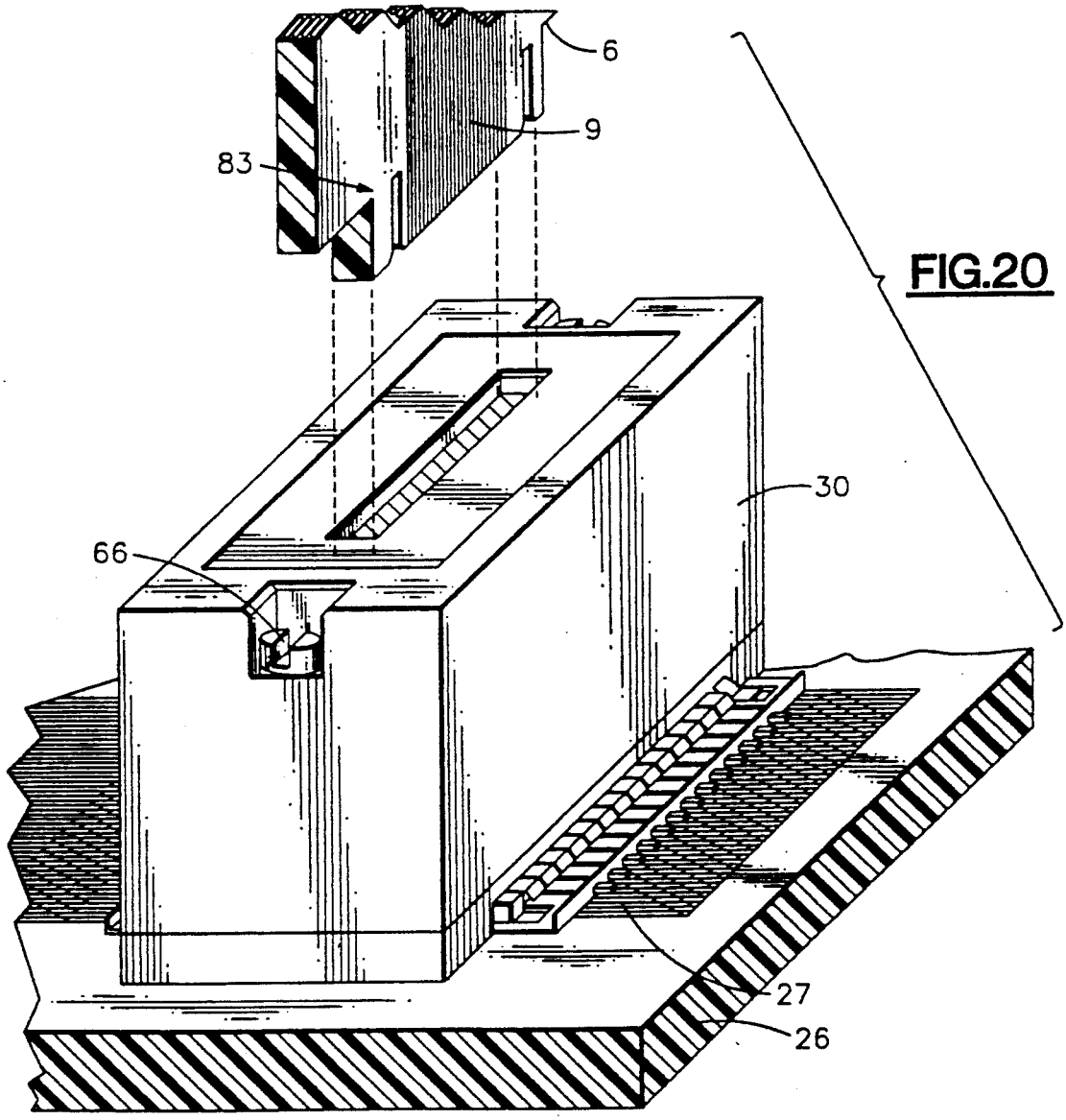
FIG.20

SELF-ALIGNING HIGH-DENSITY PRINTED CIRCUIT CONNECTOR

This is a continuation-in-part of copending application(s) Ser. No. 07/861,119 filed on Mar. 31, 1992, now U.S. Pat. No. 5,240,420.

This invention relates to a self-aligning high-density printed circuit connector system. It relates more particularly, though not exclusively, to connectors for releasably connecting contacts of a flexible or rigid circuit to conductive pads on a printed circuit board and to the interconnection of conductive pads on two such boards.

BACKGROUND OF THE INVENTION

In electrical systems, flexible printed circuits are employed as electrical jumpers or cables for interconnecting rows of terminal pins or pads of printed circuit boards. A connector, mounted to one or both ends of the jumper, is formed with a set of electrical receptacles or sockets which are designed to receive the terminal posts or contact the pads on the printed circuit board.

In today's world wide electronics market, manufacturers are placing emphasis on increasing their product's reliably and reducing assembly costs to remain competitive. A primary focus of each manufacturer is to reduce the cost and increase the circuit density associated with interconnecting the sub-assemblies and components found within its products. Another emerging focus in today's electronics market is to pack more electronic functions into smaller packages. This means higher density modules, each requiring multiple interconnections to other modules.

Connector manufacturers have not kept pace with today's market needs. Simply stated, conventional connector technology cannot accommodate todays high-density requirements. This is because existing connectors consist of individual stamped contacts assembled into a molded plastic housing. The physical size required to manufacture an acceptable spring contact eliminates this technology in high-density circuits. For the last 25 years electronic systems have been designed around conventional connector technology. Connector manufacturers have effectively led this market, and system designers gladly followed, because these connectors satisfied their needs. This cannot continue as three significant events are combining to change the role of connectors forever. They are:

a) A new generation of chips that will drive PC board manufacturers to produce boards with conductors on 0.5 mm (0.006 inch) centers. These boards must be interconnected to other modules or to the outside world and will require a high-density connector and interconnect cable.

b) A new generation of high resolution Liquid Crystal Displays will require conductors on 0.1 mm (0.004 inch) centers. These displays must be interconnected to PC boards and/or other modules. This will require a high-density connector and interconnect cables.

c) The growing use of high-density surface mount PC boards to accommodate multiple chip arrays also requires high-density connectors and custom interconnect cables for purposes of terminating.

These key events have led to development of the self-aligning high-density connector system of the present invention.

SUMMARY OF THE INVENTION

It is an object of the present invention to provide a separable connector system for reliably and releasably connecting the conductive circuit paths of a rigid or flexible circuit to very closely packed (high density) conductive pads of a PC board in a way that does not require solder, crimping or welding operations in order to interconnect the two circuits, the connector system being self-aligning to ensure reliable desired connection.

A further object is to provide such a connector system which can be formed as an inexpensive structure, is relatively easy and inexpensive to make in quantity and can be mounted to the end of a rigid or flexible circuit without requiring any tool and which can be readily connected to and aligned with contact pads on the face of a printed circuit board.

One form of the present invention is designed to interconnect two printed circuit (PC) boards and can accommodate up to 63 connectors per centimeter (160 connectors per inch) i.e. 80 connectors on each side of the PC board, i.e. four times the density of existing single row connector technology. Applications with greater densities are expected to be accommodated by the present invention.

According to the invention there is provided a connector for electrically conductive connection to electrically conductive contact pads of a circuit comprising a) a housing; b) a resilient flexible circuit assembly held captive by said housing, housed, at least in part, in said housing and having a flexible circuit with an end portion defining a row of conductive contact areas on one face thereof corresponding to said row of pads, said areas being resiliently urged into electrically conductive contact with said pads when said connector is attached at a desired location to said circuit; c) means providing limited desired float of said assembly in said housing to facilitate registration of said areas and said pads; and d) said assembly having alignment means to engage a cooperating feature of said circuit to cause registration of said areas with said pads, when said connector is attached at the desired location to said circuit, with sufficient accuracy to ensure that only the desired conductive contact between said areas and said pads is achieved.

Advantages of the present form of the invention over know prior art are:

1. Ability to terminate at least 32 separate contacts per centimeter (80 separate contacts per inch).
2. Self-alignment of each contact cluster to a mating circuit pattern using alignment features which prevent discontinuity under vibration.
3. Interlocking alignment rails preventing circuit discontinuity under vibration.
4. Compliant contact clusters which compensate for variations in board thickness.
5. Provision of a wiping contact.
6. Provision of an optional compression seal designed to protect the contact interface.
7. Mechanical components which ensure long term reliability.
8. Stored energy contacts which offer reliable and predictable contact force.
9. The spring support structure has a built-in compression indicator that alerts the installer that the connector is properly attached.
10. The ability to terminate to single or double sided P.C. boards or to a male connector.

BRIEF INTRODUCTION TO THE DRAWINGS

Embodiments of the present invention will now be described, by way of example, with reference to the accompanying drawings, in which.

Figure 4:
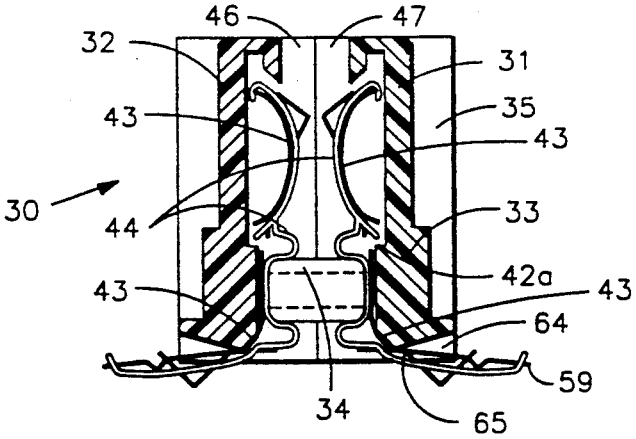
FIG. 4 is a diagrammatic cross-section view of a second embodiment of the connector according to the present invention.
Figure 5:
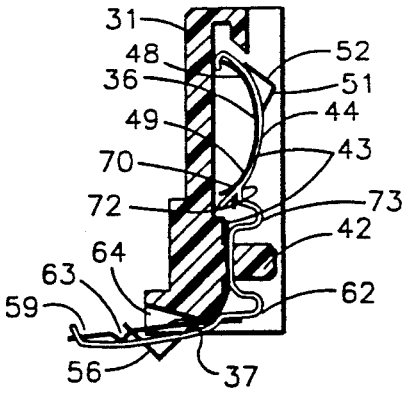
Figure 6:
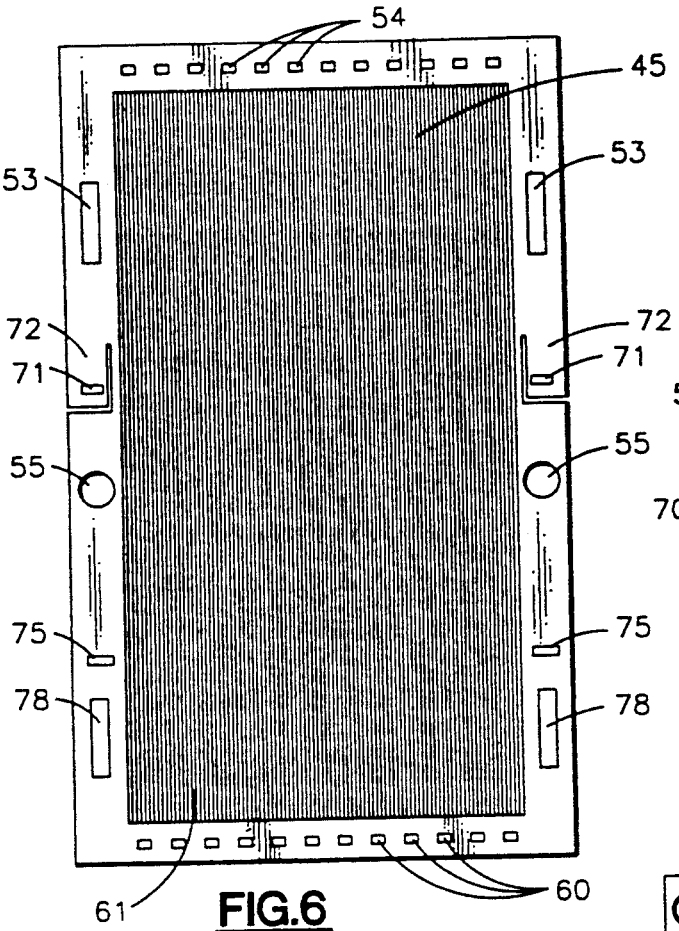
Figure 7:
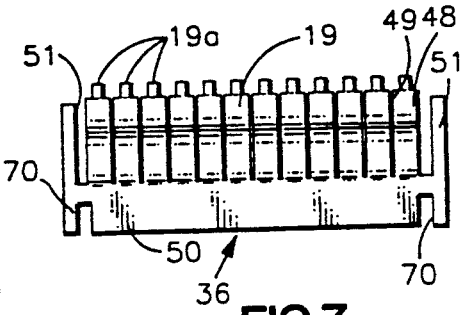
Figure 8:
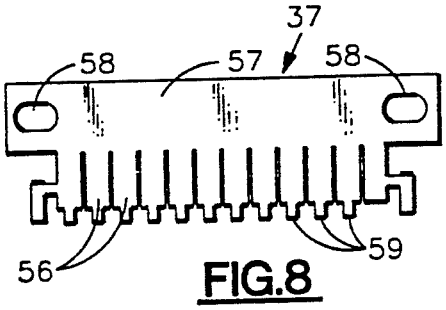
Figure 10:
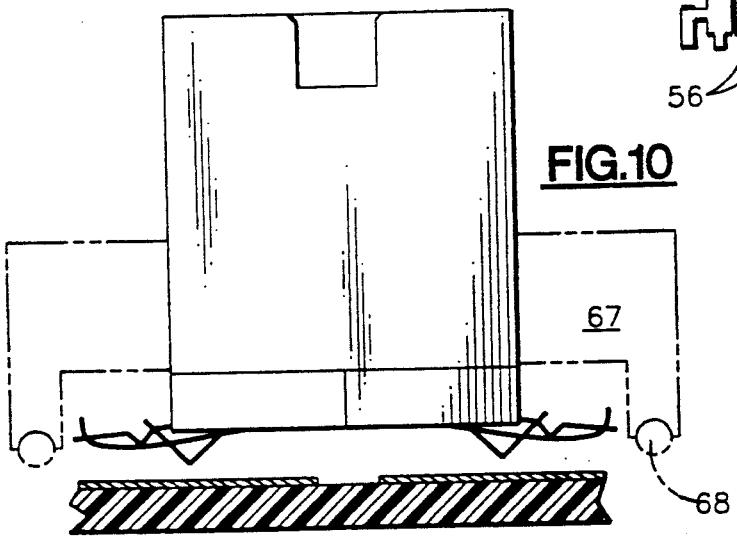
Figure 9:
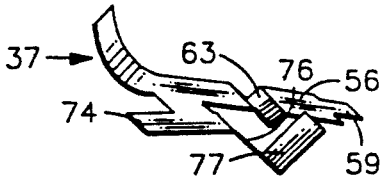
Figure 11:
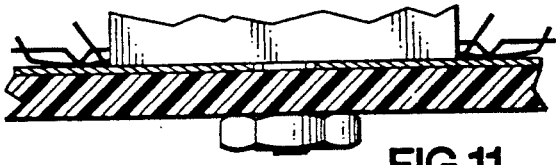
Figure 12:
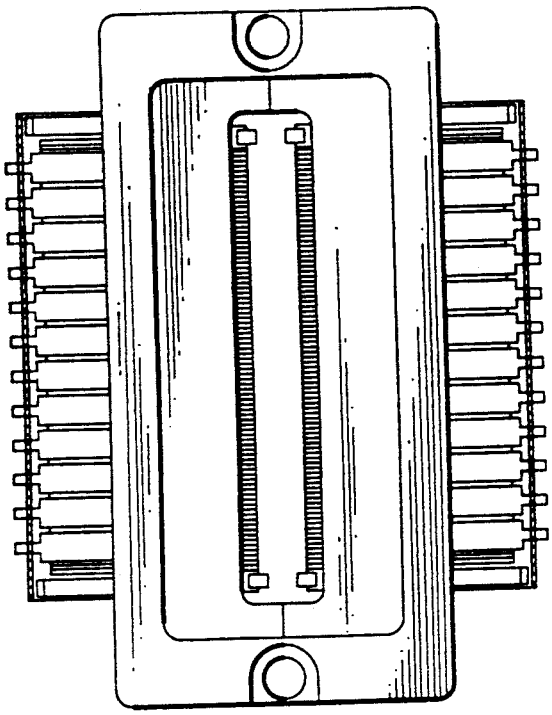
Figure 14:
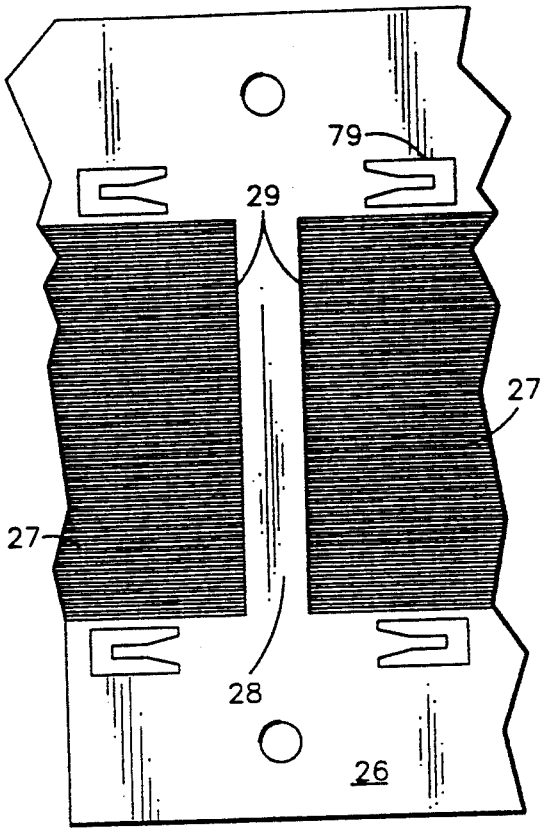
Figure 13:
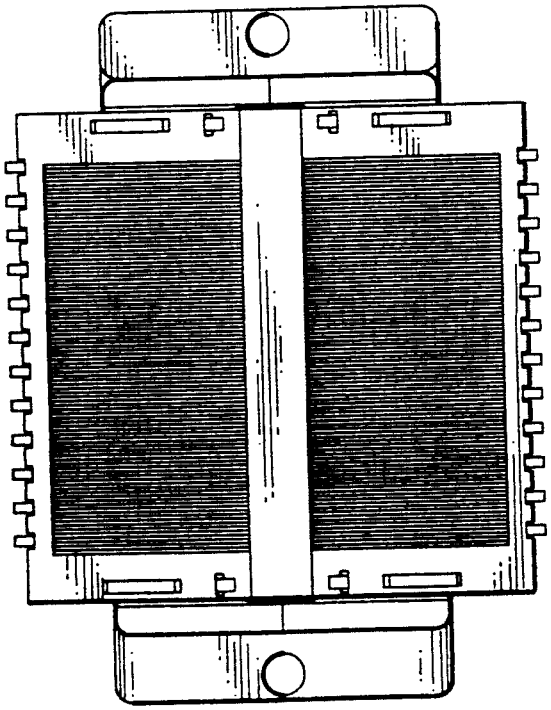
Figure 15:
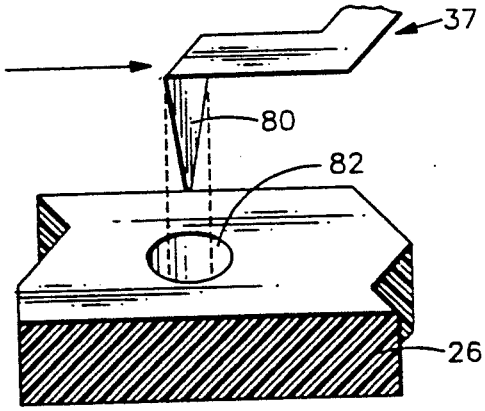
Figure 16:
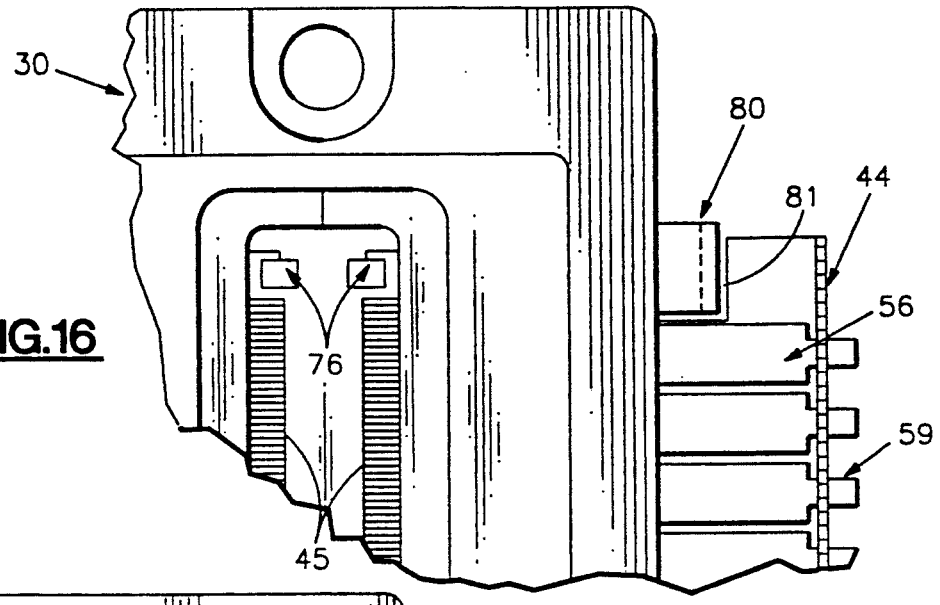
Figure 17:
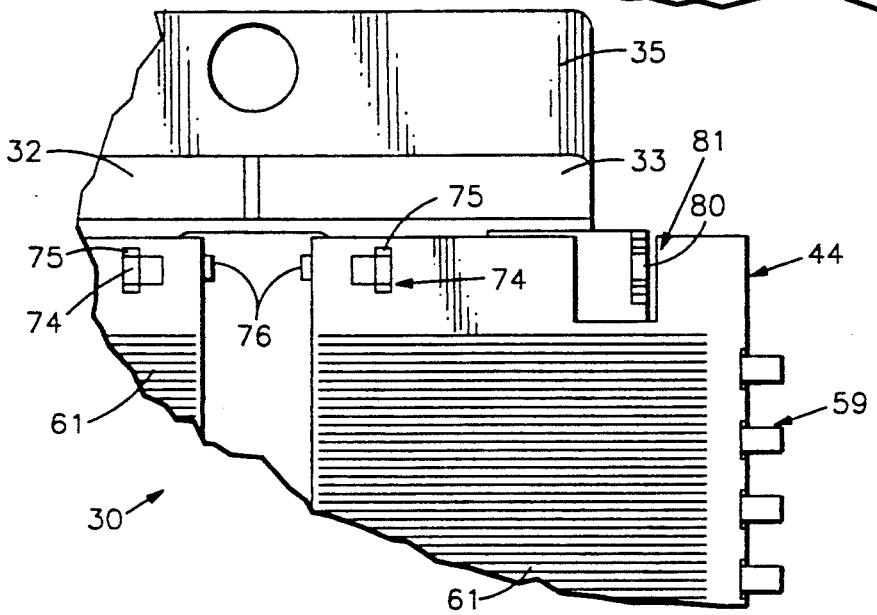
Figure 18:
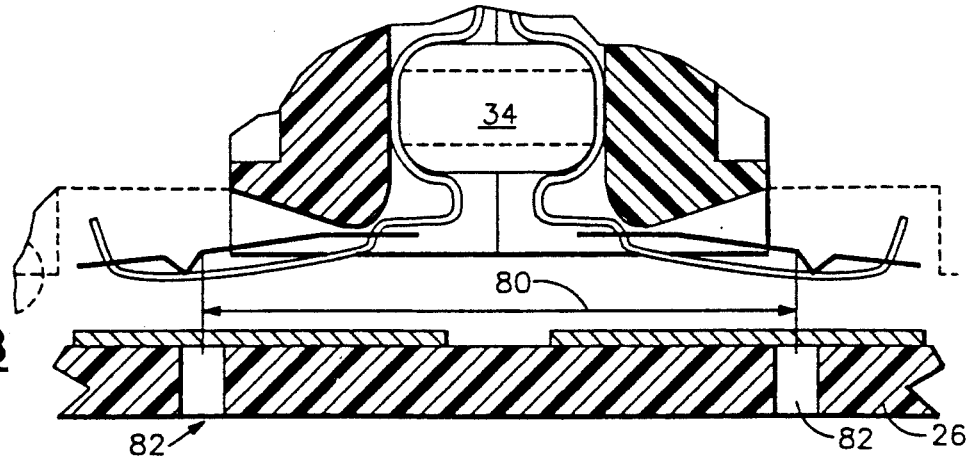
Figure 21:
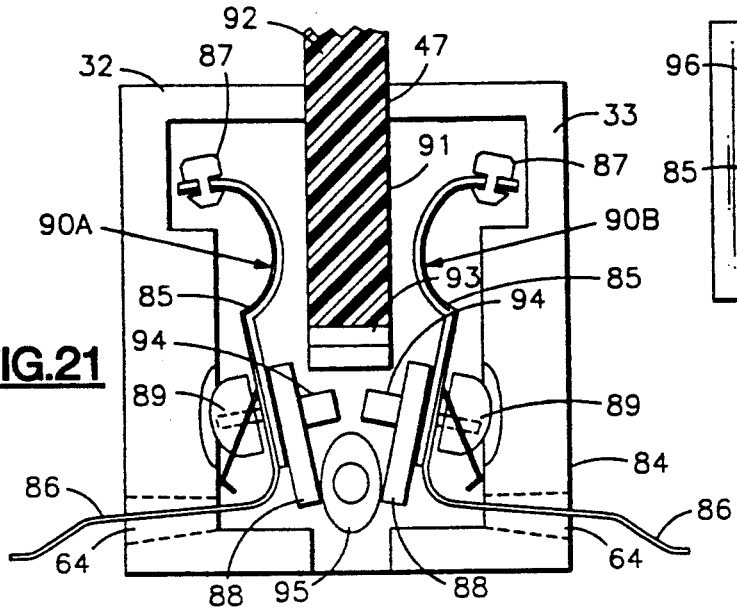
Figure 24:
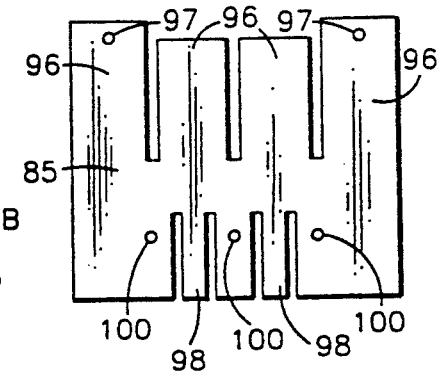
Figure 25:
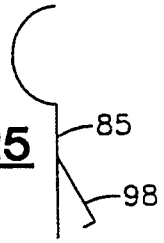
Figure 22:
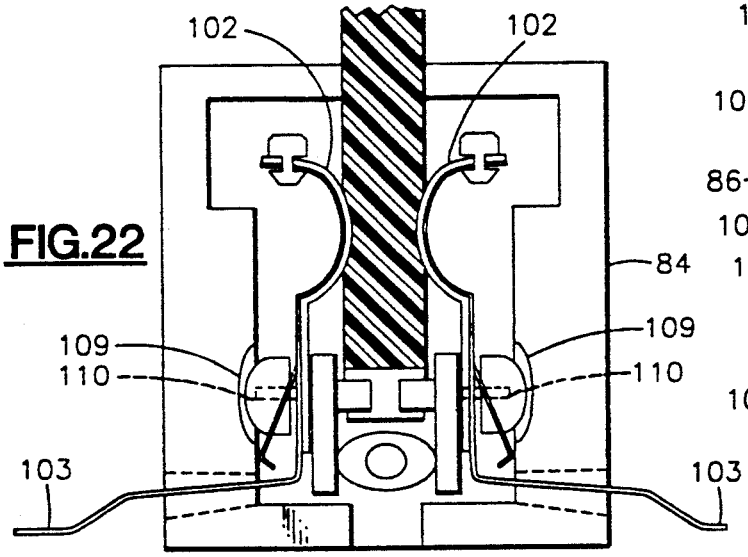
Figure 26:
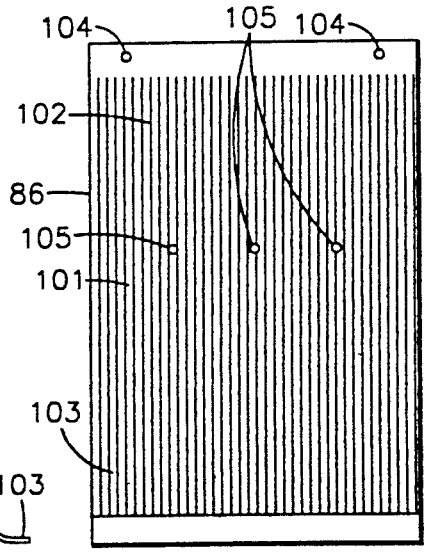
Figure 23:
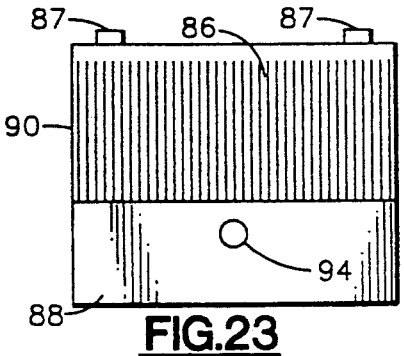
Figure 27:
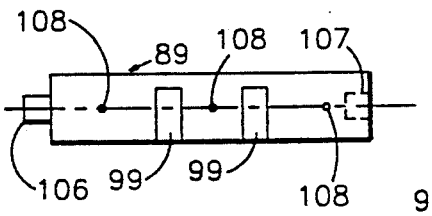
Figure 28:
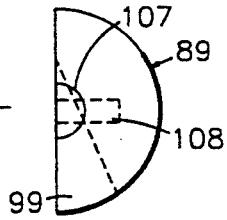
Figure 29:
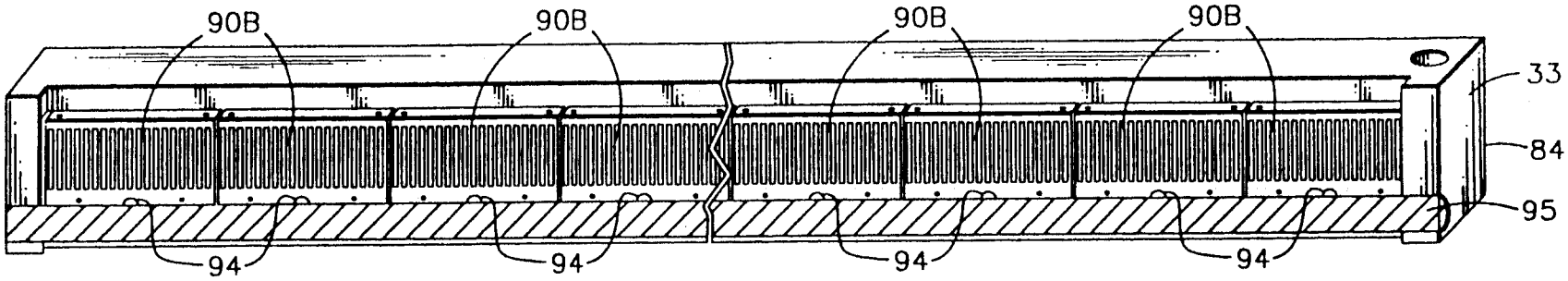
Figure 30:
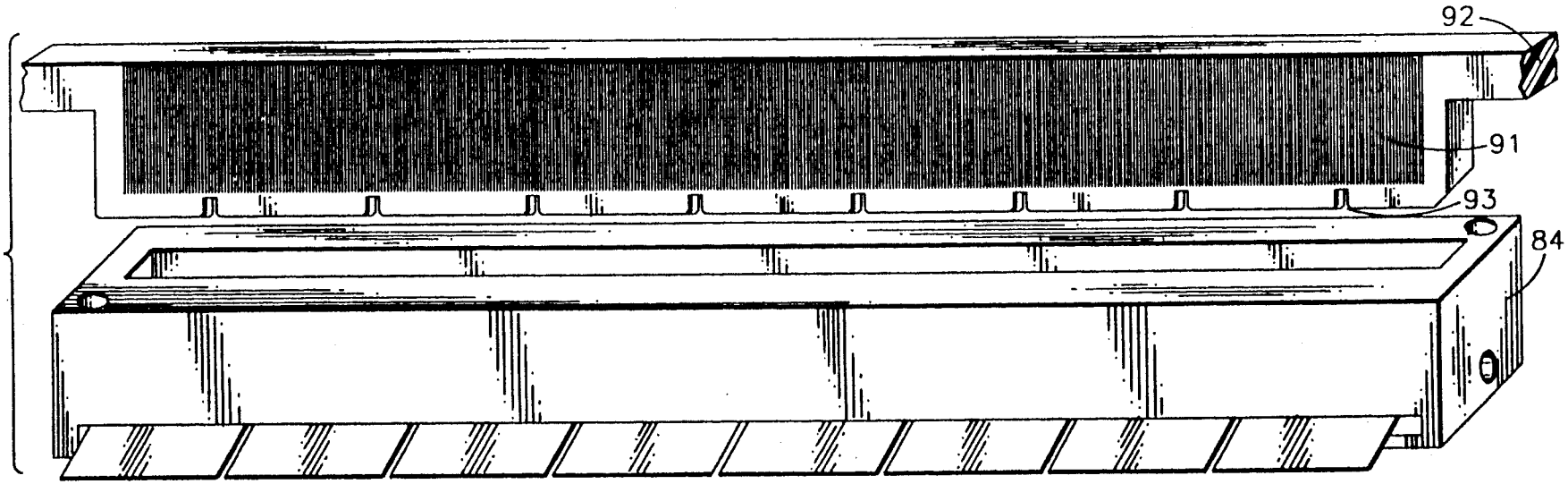
Figure 31:
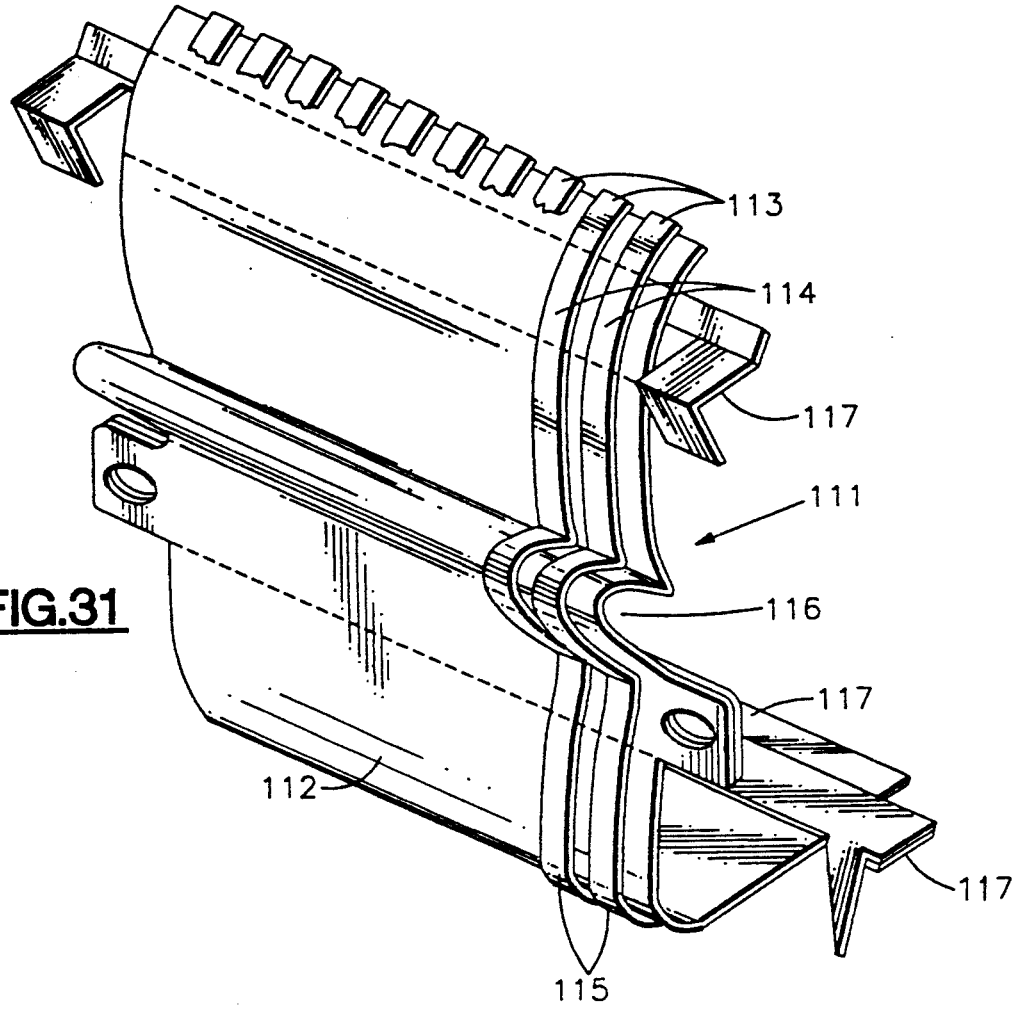
Figure 32:
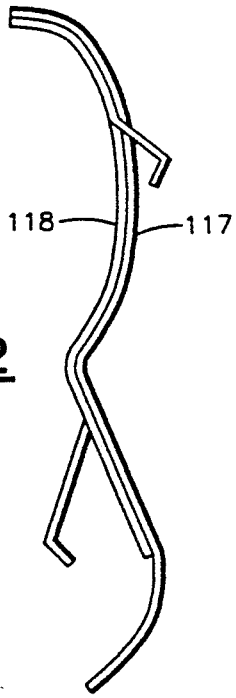
Figure 33:
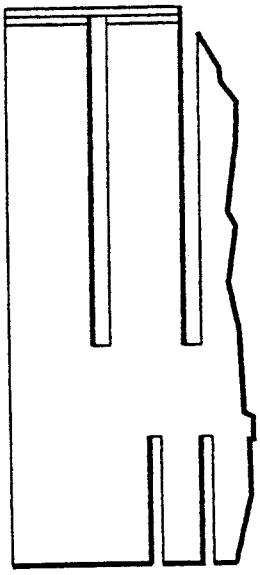

FIGS. 5–9 are diagrammatic illustrations of the various components and one sub-assembly of the connector illustrated in FIG. 4 with FIG. 5 being a sub-assembly of a housing, spring means and flexible circuit of a substantial portion of one half of the connector illustrated in FIG. 4, FIG. 6 being a front elevation of a flexible circuit, FIG. 7 being a front elevation of a first part of a spring means, FIG. 8 being a front elevation of a second part of the spring means, and FIG. 9 is a perspective view of a portion of the second part of the spring means illustrated in FIG. 8;

FIG. 10 is a diagrammatic end elevation of a connector of the second embodiment;

FIG. 11 is a fragmentary diagrammatic end elevation of a connector of the second embodiment shown attached to the face of a printed circuit board;

FIG. 12 is a plan view of a connector of the second embodiment;

FIG. 13 is an underview of a connector of the second embodiment;

FIG. 14 is a view of the face of a printed circuit board to which a connector of the second embodiment may be mounted;

FIGS. 15–20 are illustrations of a third embodiment of the present invention which is a variation of the second embodiment with FIG. 15 diagrammatically illustrating an alignment feature for aligning the connector with the surface of a circuit board, FIG. 16 being a fragmentary plan view including the alignment feature, FIG. 17 being a fragmentary underview illustrating the alignment features, FIG. 18 being a fragmentary cross-section of a connector of the third embodiment in the process of being mounted to the surface of a circuit board, FIG. 19 being a fragmentary cross-section of a connector as illustrated in FIG. 18 shown mounted to the surface of a circuit board and FIG. 20 being a diagrammatic perspective view mounted on a circuit board together with a second circuit board having an edge connector portion carrying electrically conductive contact pads for interconnection with the first mentioned circuit board by way of the connector;

FIGS. 21 and 22 are diagrammatic cross-sections of a fourth embodiment of the present invention shown in an operational states a) for insertion of an edge connector portion of a circuit board and b) connected to that circuit board respectively;

FIGS. 23–28 illustrate various components of the connector of the fourth embodiment with FIG. 23 illustrating a sub-assembly, FIGS. 24 and 25 illustrating an elevation and an end view of a spring structure of the sub-assembly of FIG. 23, FIG. 26 illustrating an elevation of a flexible circuit portion of the sub-assembly of FIG. 23, and FIGS. 27 and 28 being an elevation and an end view of a sled portion of the sub-assembly of FIG. 23;

FIG. 29 is a cut away diagrammatic perspective view of one form of connector according to the fourth embodiment;

FIG. 30 is a perspective view of the connector illustrated in FIG. 29 with an edge connector portion of a circuit board in the process of being inserted for connection thereto;

FIG. 31 is a diagrammatic perspective view of an alternative form of resilient connector sub-assembly with alignment features for use in the present invention, particularly the first and second embodiments; and FIGS. 32 and 33 are respectively an end elevation and a fragmentary front elevation of another resilient connector sub-assembly for use in the present invention, particularly the first and second embodiments thereof.

DESCRIPTION OF PREFERRED EMBODIMENTS

Figure 1:
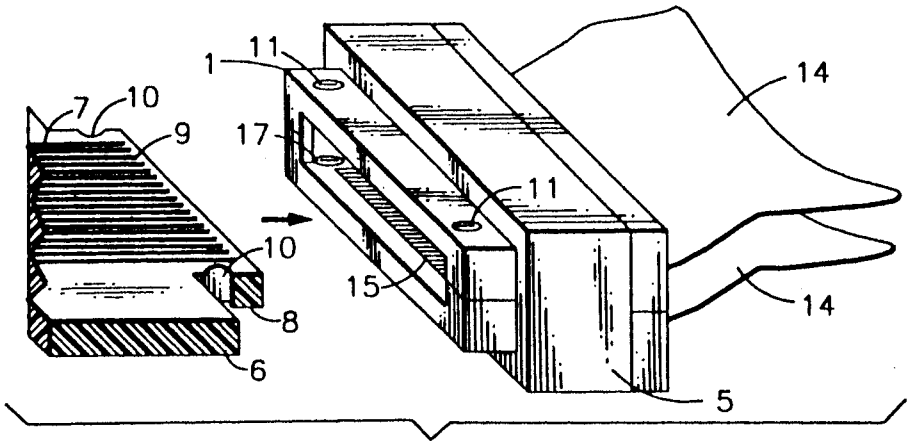
FIG. 1 is a diagrammatic perspective view of a first embodiment of a connector according to the present invention shown with a portion of a printed circuit having an edge connector portion carrying a plurality of electrically conductive contact pads.
Figure 3:
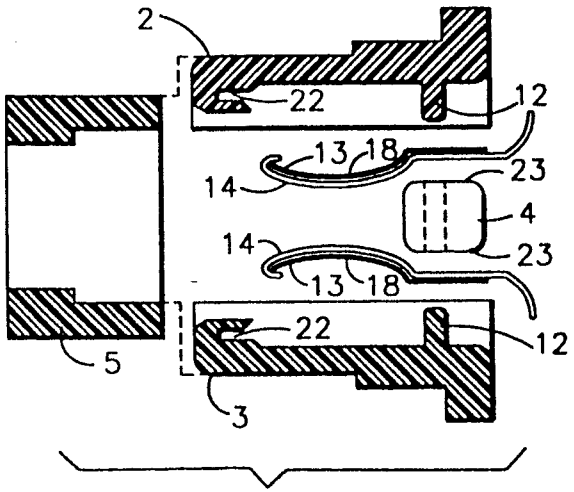
FIG. 3 is an exploded view similar to the cross-section of FIG. 2 illustrating the various components of the connector of the first embodiment with FIGS. 3A and 3B being diagrammatic fragmentary illustrations of two of these components.
Figure 2:
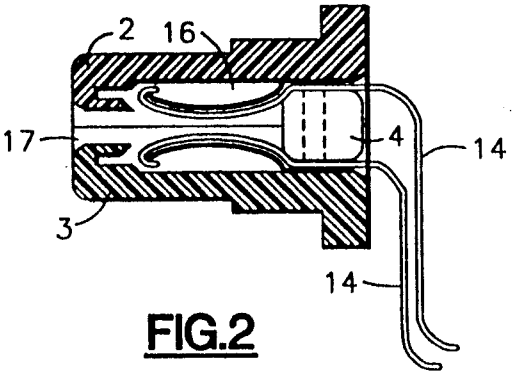
FIG. 2 is a diagrammatic cross-section of the connector illustrated in FIG. 1.

The first embodiment of connector according to the present invention will now be described with reference to FIGS. 1–3.

A molded plastic connector housing 1 consists of first and second housing halves 2 and 3 spaced apart by a spacer 4 of an electrically insulating material. The housing halves 2 and 3 are joined together, to form the housing 1, by a support ring 5 which in the assembled connector encompasses the housing halves. The support ring may be molded of plastic and may join the housing halves 2 and 3 together in a substantially permanent manner by the use of ultrasonics, adhesives or other means well known to those skilled in the art.

PC board 6 carries an array of circuit paths 7 terminating at an edge connector portion 8 in a row of electrically conductive contact pads 9. A similar row of pads (not shown) is located on the underside of the PC board 6 with the two rows of pads being superimposed as a mirror image of one another. The edge connector portion 8 includes recesses 10 which may be used to captively locate the PC board relative to the connector housing 1 by means of pins 11 passing through openings in the housing 1. Although these pins 11 are shown installed in the housing 1, it will be appreciated that in actual use they will be installed only after the edge connector portion 8 is inserted into the housing.

The first and second housing halves 2 and 3 each include a pair of spaced apart mounting pins 12 (one only being shown for each housing half) by means of which the internal components of the connector, including the spacer 4, are captively held and located within the housing 1. The internal components consist of a pair of spring means 13 and a pair of flexible circuits 14 each circuit comprising a flexible substrate carrying a plurality of electrical conductors terminating, at an end of the flexible circuit within the connector, in electrically conductive circuit areas 15 positioned to connect with the pads of the PC board when the connector is attached the edge connector portion of the PC board.

Figure 3A:
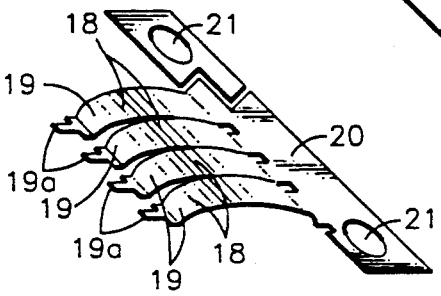
Figure 3B:
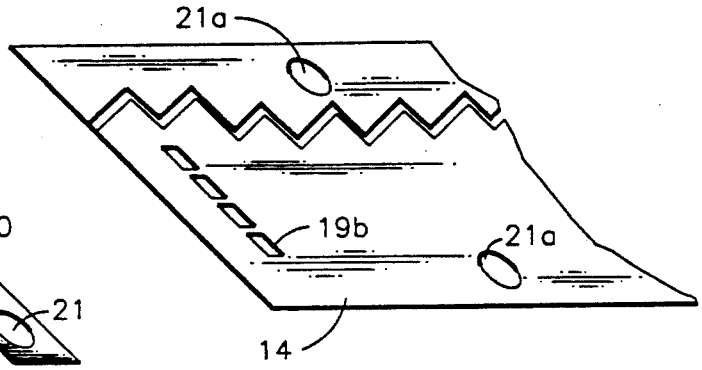

The flexible circuits 14 extend into a cavity 16 of the housing 1 and are located by the pins 12 which engage openings 21A in the flexible circuits 14 so that the areas 15 of the flexible circuits 14 align with the pads of the PC boards 6 when the edge connector portion 8 thereof is inserted into the connector through an edge connector portion receiving aperture 17 of the housing. The flexible circuits 14 are spaced apart by the spacer 4, with their contact areas facing one another, and are biased toward one another by arched portions 18 of the spring means 13 which are located in the housing by engagement of openings in the spring means with the pins 12 between the flexible circuits 14 and the respective housing halves 2 and 3. The arched portions 18 of the spring means 13 overlap the aperture 17 to resiliently bias the contact areas 15 of the flexible circuit into engagement with pads of a PC board to which the connector is attached. Each spring means 13 (FIG. 3*a*) is a comblike metal structure in which the arched portions 18 are formed in parallel leaf spring portions 19 interconnected at one end thereof by a cross-member 20. The cross-member serves to maintain the leaf spring portions 19 in parallel alignment with one another and to located the spring means relative to the contact areas 15 of the flexible circuit and the cavity 16 of the housing 1 by means of holes 21 positioned and sized to accommodate the pins 12. Each leaf, of the spring 13, is free to independently deflect to achieve the desired compliance and compensate for variations in board thickness. The adhesive and dielectric of the flexible circuit may also be designed to offer selected compliance to individual conductors.

With high-density packing of the pads 9, the holes 21 may be sized, together with the corresponding openings of the flexible circuits, to allow a desired amount of float of the spring means 13 and the flexible circuits 14 to ensure proper alignment of the contact areas 15 and the pads for the desired electrical connection of the pads directly with the contact areas 15 under the influence of the resilient arched portions of the spring means 13. With the allowed float and use in high density packing of the pads, the interlocking alignment rails 51 align each contact cluster to the mating circuit pattern 9 on the P.C. board. This alignment means ensures that registration of contact areas and pads is provided as described hereinafter.

In the illustrated embodiment, each leaf spring 19 is common to four contact areas. It will be appreciated by those skilled in the art that each particular application will determine the number of contact areas common to each leaf spring and that a single leaf spring construction common to all contact areas of each flexible circuit may find application where the resilient compressibility of the substrate of the flexible circuit and/or an intermediate element is provided to ensure the application of a sufficiently even electrical contact producing pressure between the contact areas 15 and the pads throughout the length of the rows of pads. The spring means 13 are each captively retained by the pins 12 of the associated housing halves 2 or 3 with the free ends of the leaf springs 19 engaging a housing recess 22 adjacent the aperture 17. The ends of each of the leaf springs 19 are shaped to define tabs 19*a* which engage corresponding openings 19*b* in the end portion of the associated flexible circuit 14 to locate the flexible circuit relative to the leaf spring. With high-density packing of the pads 9, the contact of the leaf springs and the flexible circuits with the recesses 22 is sufficiently free to allow sufficient floating movement of the spring means 13 with its associated flexible circuit 14 to allow the desired alignment between the contact areas 15 and the pads of the PC boards 6. To this end the spacer 4 has recessed areas 23 which prevent the leaf springs 13 and the flexible circuits 14 from being tightly clamped against the first and second housing halves 2 and 3. In the embodiment shown the holes 21 are oval in order to facilitate the desired floating movement.

The ends of the flexible circuits 14 which are remote from the connector described may be terminated in any conventional manner or may be terminated in a similar connector to that described to provide an interconnect for edge connector pads of two PC boards.

It will be appreciated that the engagement of the leaf springs 19 with their attached flexible circuits to the recesses 22 is to ensure that the free ends of the leaf springs 19 and the associated end portions of the flexible circuits 14 do not interfere with the insertion of an edge connector portion of a PC board to the connector. The free end portions of the leaf springs 19 and the cross-member 20 serve to provide the contact with the first and second housing halves 2 and 3 required for the application of the necessary spring force by the arched portion of the leaf spring to achieve the desired electrical contact between the contact areas and the pads.

The spring means 13 may be constructed of a material or coated with a suitable material to provide, with the substrate of the flexible circuits, an impedance desired where the flexible circuit communicates direct with a PC board.

The second embodiment of the invention will now be described with reference to FIGS. 4–14. The connector of the second embodiment includes construction features which function substantially in the same way as the features of the first embodiment of the connectors described with reference to FIGS. 1–3 for connection to an edge connector portion of a PC board 6 carrying rows of pads as described with reference to the first embodiment. However, the connector of the second embodiment is designed as a self-aligning high-density connector for mounting directly to one face of a further printed circuit board 26 having conductive paths 27 terminating at a connector location 28 in contact pads 29 disposed in parallel rows of pads having a high density center to center spacing of, for example, 0.3 mm (12 mils).

In the second embodiment connector 30 has a molded plastic connector housing 31 consisting of first and second housing halves 32 and 33 spaced apart by a spacer 34 of an electrically insulated material, the housing halves 32 and 33 being joined together to form the housing 31 by a support ring 35 which in the assembled connector encompasses the housing halves. The support ring may be molded of plastic and may join the housing halves 32 and 33 together in a substantially permanent manner by the use of adhesives or other means well known to those skilled in the art.

The first and second housing halves 32 and 33 each include a pair of spaced apart mounting pins 42 (one only being shown for each housing half) by means of which certain internal components of the connector including the spacer 34 are captively held within the housing 31. The internal components consists of a pair of spring means 43 each consisting of first and second spring structures 36 and 37 and a pair of flexible circuits 44 each comprising a flexible substrate carrying a plurality of electrical conductors terminating, at one end of the flexible circuit within the connector, in electrically conductive contact areas 45 positioned to connect with the pads 9 of the PC board when the connector is mounted on the edge connector portion 8 of the PC board 26.

The flexible circuits 44 extend into a cavity 46 of the housing 31 and are located by the pins 42 which engage openings in the flexible circuits 44 to retain them within the housing 31. The flexible circuits 44 are spaced apart by the spacer 34 with their contact areas facing one another and are biased toward one another by arched portions 48 of the first spring structures 36 of the spring means 43 which are located in the housing by engagement with abutment 42*a* between the flexible circuits 44 and the respective housing halves 32 and 33. The arched portions 48 of the spring means 43 overlap the aperture 47 to resiliently bias the contact areas 45 of the flexible circuit into engagement with pads of a printed circuit 6 on which the connector is mounted. Each first spring structure 36 (FIGS. 4 and 8) is a comb-like metal structure in which the arched portions 48 are formed in parallel leaf springs 49 interconnected at one end of each leaf spring by a cross-member 50 which serves to maintain the leaf springs portions 19 in parallel alignment with one another.

At the ends of the cross-member 50 are circuit to board alignment rails 51 the free ends of which are folded to form projections 52 positioned to extend through rectangular openings 53 in the flexible circuit 44 and to engage those openings to maintain the spring means in a desired alignment with the flexible circuit. The projections 52 terminate in contact with the conductive contact area carrying face of the flexible circuits adjacent the side edges thereof. The projections 52 are designed to mate with alignment tracks (not shown) in PC boards having an edge connector portion 8 to which the connector 30 is to be connected and the rails 51 are resiliently flexible to enable the projections 52 to be urged apart as an edge connector portion of a PC is insert into the aperture 47. The projections 52 each overlap the aperture 47 by a minimum of 0.12 mm (5 mils) more than the arched portions of the spring means 43 whereby the pressure otherwise applied by the arched portions is relieved somewhat until the projections 52 engage the tracks. This allows easier floating movement facilitating alignment.

The spring means 43 are accommodated in cavity 46 of the housing 31 in engagement with recesses corresponding to recesses 22 with tabs 19*a* at the ends of the leaf springs engaging corresponding rectangular openings (here 54) in one end of the flexible circuits 44 in order to retain the lateral alignment of the flexible circuits 44 with their associated first spring structures 36. Openings 55 locate the flexible circuits 44 in the housing by engagement with pins 42. The shape and sizing of these openings is arranged to permit sufficient float of the flexible circuits 44 together with the spring means 43 relative to the housing to ensure alignment of contact areas of the flexible circuits with contact pads of the print PC boards when the connector is connected thereto. In the preferred form the openings 55 are oval to facilitate float in a sideways direction while restricting float longitudinally of the flexible circuits. While the first spring structures 36 are captively housed in the housing 31, these spring structures are permitted a degree of float consistent with the float of the flexible circuits 44 while their alignment with those circuits is ensured by the engagement of the projections 52 with the rectangular openings 53 and tabs 19*a* with openings 54. Sufficient clearance is provided to ensure unrestricted desired deformation of the first spring structures 36 in the housing.

Tabs 70 on the first spring structures 36 aligned with the guide rails 51 are arranged to engage openings 71 in tabs 72 formed in the side edges of the flexible circuits 44 to assist in alignment, retention and positioning of the flexible circuits relative to the first spring structures 36.

The second spring structures 37, which also form part of the spring means 43, have a plurality of leaf springs interconnected at one end thereof by a cross-member 57 defining a pair of openings 58 sized and shaped to encompass the pins 42 while permitting contact aligning float of these second spring structures with the associated end of the flexible circuits 44. The end of these leaf springs also include tabs 59 arranged for cooperation with corresponding rectangular openings 60 located in the associated ends of the flexible circuits 44. Alignment of the contact areas 61 with the associated contact pads 29 of the further PC board 26 is provided by the allowed float of the second spring structure 37 and the associated ends of the flexible circuits 44 and as a result of the shape of the openings 55 and/or by the provision of a return tuck 62 in the flexible circuits 44 accommodated within the housing 31.

The second spring structures 37 also include tabs 74 (FIG. 9) to engage openings 75 in the edges of the flexible circuits to assist in alignment, retention and position thereof.

As with the first embodiment of the present invention, the spacer (here 34) includes recessed areas to facilitate the desired float of the spring means 43 and the flexible circuits 44. In both embodiments, the spring means and the flexible circuits include features ensuring their alignment. However, these components are not fixedly connected together and can move independently, within the bounds provided by the alignment arrangement, as they flex in use. In the preferred embodiment each leaf spring of each structure 36 and 37 is common to four contact areas. It will be appreciated by those skilled in the art that a particular application will determine the number of contact areas common to each leaf spring and a single leaf spring, for each structure 36 and 37, common to all contact areas of each flexible circuit end may find application where the resilient compressibility of the substrate of the flexible circuit or an intermediate element is provided to ensure the application of a sufficiently even electrical contact producing pressure between the contact areas 45 and the pads 9 and 29 throughout the length of the rows of pads.

The second spring structures 37 are formed so that the cross-member 57 mounted on the pins 42 lies not only transversely of the leaf springs 56 but also in a plane normal or substantially normal to the plane of the leaf springs 56 (FIG. 12). By virtue of this, leaf springs 56 extend through a side opening of the associated housing half 32 or 33 to enable the associated end portion of the associated flexible circuit 44 with its contact area 61 to lie on top of one face of the further PC board 26 to which the connector is to be attached. In this arrangement, the leaf springs of one of the second spring structures 37 extend oppositely to and in the same plane as the leaf springs of the other of the second spring structures 37. The leaf springs 56 include folded portions 63 adjacent their free end shaped to ensure that the leaf springs 56 resiliently urge the associated contact areas 61 into contact with the contact pads 29 when the connector is attached to the further PC board 26. The housing halves 32 and 33 include relieved areas 64 in the openings 65 through which the leaf springs 56 extend to accommodate deflection of these leaf springs in use. It will be appreciated that leaf springs are shaped in order to be resiliently deformed as the connector is attached to the further printed circuit board in order to ensure that the necessary contact of areas and pads as achieved.

Secure attachment of the connector 30 to the further printed PC board 26 may be assured by attachment screws 66 or other attachment means which will be well known to those skilled in the art. The allowed float of the flexible circuits together with the self-aligning provisions of the second spring structures 37 and the associated structure of the further PC board ensures the alignment of the contact areas 61 with the pads 29.

The second spring structures 37 include resilient guide rails 76 including folded portions 77 which pass through slots 78 in the edges of the flexible circuits to engage alignment tracks 79 formed in the further printed circuit board 26. The rails 76 extend beyond the folded portions 63 of the leaf springs 56 to relieve spring pressure during alignment and to restore that pressure once alignment is achieved.

In an alternative embodiment (not illustrated) the leaf springs 56 may be folded back upon themselves over the contact areas 61 to be encompassed with those areas 61 substantially under the sidewalls of the housing 31 whereby the housing itself essentially completely covers and protects the region in which the contact areas contact the contact pads of the further PC board 26. Alternatively, protective shrouds 67 (shown in ghost in FIG. 10) may be utilized together with an associated compression seal 68 to achieve the same end.

The leading edge of the circuit in at least the first and second embodiment are positioned under a molded plastic lip to protect it from lifting or buckling during PCB insertion.

The third embodiment of the present invention will now be described with reference to FIGS. 15–20. The structure of the connector of the third embodiment is somewhat similar to that of the second embodiment and elements thereof which are substantially the same as those of the second embodiment will not be described again with reference to these figures. Further, where components are substantially the same as components of the second embodiment the same reference numerals will be utilized.

In this embodiment the resilient guide rails 76 are replaced by tapered projections 80 and pass-through slots 78 are replaced by cut-outs 81 which permit the projections 80 to extend through the edges of the flexible circuits 44 for aligning engagement with openings 82 in circuit board 26. The tapered feature of the projections 80 permits easy initial alignment of the connector with the circuit board 26 with continued insertion of the projections 80 into the openings 82 precisely aligning the flexible circuit contact areas of the connector 30 with the contact pads of the circuit board 26 by virtue of the engagement of the taper of the projections 80 with the openings 82.

In the third embodiment, the alignment features for alignment of the flexible circuit of the connector 30 with an edge connector portion of a circuit board, such as circuit board 6, are substantially the same as those described with reference to the second embodiment. In this third embodiment, the edge of a printed circuit board 6 is illustrated with alignment slots 83 which may be metallic and may be built into the dielectric material, formed by deposition and etching or otherwise attached to the circuit board 6. These slots 83 (one only being shown in FIG. 20) engage alignment rails 76 for precisely aligning the edge connector portion of the circuit board 6 with the flexible circuit conductors of the connector 30.

Referring now to the fourth embodiment firstly as illustrated in FIGS. 21 and 22. In this embodiment, connector 84 includes housing halves 32 and 33 (somewhat similar to those described with reference to the second embodiment but with the spaced apart mounting pins omitted) are mounted together by means of a mounting ring similar to that described with reference to the first embodiment but not illustrated in the figures relating to the fourth embodiment. The internal components of connector 84 consist of a pair of spring means 85 and a pair of flexible circuits 86 held together in alignment with one another by locking buttons 87 and alignment/locking caps 88 with associated alignment facilitating sleds 89 to form a pair of spring/flexible circuit assemblies 90A and 90B. The assemblies 90A and 90B are captively held within the connector housing while being free to float within that housing to provide self alignment of the assemblies with the edge connector portion 91 of a circuit board 92 by means of alignment slots 93 (one only being shown in FIGS. 21 and 22) by virtue of the interaction of the slots 93 with alignment pins 94 formed on the alignment/locking caps 88. The connector 84 also includes a substantially elliptical cam 95 extending through the housing to which it is mounted for rotation relative thereto with the axis of the cam traversing the width of the assemblies 90A and 90B. The cam is located between the assemblies for rotation to move both assemblies from the position shown in FIG. 21 to the position shown in FIG. 22 and allow movement back again under the bias of spring tongues 98 (described below) as desired. This moves the assemblies 90A and 90B from the circuit board release position illustrated in FIG. 21 to the operational condition illustrated in FIG. 22 in which the conductors of the flexible circuits 86 are resiliently urged into contact, under the influence of the spring means 85, with the edge contact pads of the edge connector portion 91 of the circuit board 92 and from this state back to the release position.

It will be appreciated that movement between the operational conditions shown in FIGS. 21 and 22 could be achieved by other means than the use of a rotary cam, for example, a sliding cam could be used as could the communication of the alignment slots 93 with the alignment pins 94 to bring the assemblies 90 and 91 into electrical contact forming contact with the edge connector pads.

It will also be appreciated that while the cam is shown as an elliptical cam, the cam could be modified so that flats are formed on the cam surface at the extremes of the major axis of the cam to provide a self locating feature which locates the assemblies 90A and 90B in the operating condition shown in FIG. 22 by virtue of the resilient pressure of the alignment/locking caps with those flats. Other profiles will also be apparent to those skilled in the art.

In the fourth embodiment, the ends of the flexible circuits 86 remote from the locking buttons 87 extend through openings 64 laterally from the connector 84 for connection to components or another circuit board by soldered connection or other form of connection as will be well known to those skilled in the art.

The cam may be provided with means associated with the housing for locking it in a desired orientation, for example that shown in FIG. 22, by locking means (not shown).

Various components of the connector 84 will now be described with reference to FIGS. 23–28 in conjunction with FIGS. 21 and 22.

The assemblies 90A, 90B are located in the housing of the connector 84 in mirror image opposition to one another. The inwardly facing elevation for assembly 90A is illustrated in FIG. 23 wherein the spring means 85 is obscured by the associated flexible circuit 86 and the associated alignment/locking cap 88 which carries an alignment pin 94. The spring means of this assembly 90A is captively held in alignment with its flexible circuit 86 by two locking buttons 87 which extend through openings in the spring means and circuit board to lock these members together. The locking buttons 87 connect the spring means and the circuit board together close to the ends of these components adjacent the opening 47 of the connector through which the edge connector portion 91 extends for connection to the conductive contacts of the flexible circuits of the connector.

One of the spring means 85 is illustrated in FIG. 24 before it is shaped. The end elevation for the formed spring means 85 is illustrated in FIG. 25. Each of the spring means 85 defines a plurality of parallel leaf springs 96 at the outer free ends of the outer two of which are alignment openings 97 for receiving locking buttons 87. Remote from the leaf springs 96 are formed a pair of spring tongues 98 which in the forming of the spring 85 are bent out of the plane of the base portion of the spring so that they may pass through grooves 99 (see FIGS. 27 and 28) of a sled 89. The base portion of each spring 85 defines three alignment openings for the passage of alignment pins described below with reference to the alignment/locking caps.

Each flexible circuit 86 (see FIG. 26) defines a plurality of conductors 101 extending from an edge connector contacting portion 102 to a base portion 103 configured for connection to the surface of another circuit board or other component. The flexible circuits 86 each include alignment openings 104 consistent with the alignment openings 97 of the spring means 85 and three alignment openings 105 consistent with the three alignment openings 100 of the spring means 85.

The sled 89 illustrated in FIGS. 27 and 28 is illustrated in a form for use when a series of assemblies 90A and 90B are disposed in series along the length of a connector (see for example FIG. 29) and to this end each of the semi-circular sleds 89 each define, concentric with the axis of its semi-circular form, a boss 106 designed to engage a corresponding opening in another such sled when located longitudinally with respect to the illustrated sled 89 (see FIG. 29).

The sled illustrated has such a corresponding opening 107 at the end thereof remote from the boss 106. Each sled 89 includes transverse grooves 99 sized and shaped to accommodate the spring tongues 98 of a spring means 85 which engage the housing to bias the assembly 90A and 90B toward the release position of FIG. 21. The sled, which is obscured by the rest of the assembly in FIG. 23, projects from the rear of the assembly with its semi-circular surface in engagement with a corresponding groove 109 which in conjunction with the sled permits limited rotation of the assemblies 90A and 90B between the operating states illustrated in FIGS. 21 and 22. At the same time, the sled limits movement of the assemblies transversely of the grooves 109.

Alignment/locking caps 88 not only provide alignment pins 94 extending into the area of insertion of the edge connector portion 91 but also provide, extending in the opposite direction from pins 94, three pins 110 (only one being shown in FIGS. 21 and 22) which extend through the alignment openings 100 of the spring means 85, the alignment openings 105 of the flexible circuits 86 and into the alignment openings 108 of the sleds 89. The pins 110 engage the openings 108 of the sleds 89 to produce the unified assembly illustrated in FIG. 23. The pins 110 have an interference fit with openings 108 to positively connect the components of the assemblies 90A and 90B together. As will be appreciated by those skilled in the art the connection of the pins 110 with the openings 108 could, alternatively, be by means of an adhesive, ultrasonic welding, etc.

The location and retention of the assemblies 90A and 90B within the housing connector 84 is assured in the fourth embodiment of this invention by the cam 95 and the location of the sleds 89 in the longitudinally extending grooves 109 of the housing halves 32 and 33.

The locking buttons 87 are preferably constructed of a resilient material to facilitate their introduction through the alignment openings 97 and 104 to connect the leading edges of the spring means and the flexible circuit in relation to one another.

With reference now to FIG. 29, a connector 84 having nine assemblies 90A and 90B (only 8 assemblies 90B being shown) provides a 720 contact connector with 40 contacts for each of the 18 assemblies with 360 contacts per side. Each assembly may be approximately 25 millimeters (1 inch) wide having 40 conductors each 0.25 millimeters (0.010 inch) wide.

It will be appreciated the various assemblies 90A and 90B are each capable of independent floating movement within the connector 84 so that each of these assemblies may be aligned with the corresponding groups of contact pads of the edge connector to which the connector is intended for attachment by virtue of the precise communication between the alignment slots 93 of the edge connector portion and the alignment pins 94 of the various assemblies 90A and 90B. The alignment slots 93 each have a tapered entrance to facilitate alignment with the pins. The tapered entrance leads to a parallel locating slot for positive and accurate aligning engagement with the pins 94 of the various assemblies 90A and 90B. In such an assembly the sleds 89 are serially spaced with their bosses 106 engaging the next sleds opening 107 with a sufficient longitudinal clearance between them to permit adequate float of the individual assemblies 90A and 90B to provide for the necessary alignment with the contacts of the edge connector contacting portion 102.

In an alternative form of the connector illustrated in FIG. 29 with multiple assemblies the cam 95 can have progressive actuating surfaces so that the assemblies 90A and 90B are sequentially brought into resilient contacting engagement with the edge connector portion 102. To achieve this, the cam profile may be progressively changed to alter the location at which the change of position of the assemblies is achieved or may be changed in a series of steps to achieve the same end.

By virtue of the constructional features of the fourth embodiment in this invention, there is provided easy insertion of an edge connector contacting portion of a circuit board into the connector combined with a firm wiping contact of the conductors of the connector with the conductors of the edge portion, and the provision of firm contact between these conductors together with compensation for variations in circuit board thickness without changes in connector design. At the same time self-aligning ability of the connector is retained together with the ability to terminate and connect individually to up to 63 contacts per centimeter (160 contacts per inch) of a circuit board i.e. 80 contacts on each side of the board. By virtue of the design a controlled impedance application can be accommodated with minimum impedance discontinuity while achieving acceptable levels of cross talk. This design achieves long term reliability in combination with a predictable contact force resulting from predictable stored energy contact forces. Additionally, each contact may be individually sized to accommodate specific electrical needs, such as power runs, shielding or impedance parameters and still mate with a preexisting circuit board edge connector. A further important feature of the fourth embodiment is the ability to protect the leading edge of a edge connector portion of a circuit board during an insertion of that edge into the connector. This results from the freedom of insertion of that edge connector portion as shown in FIG. 21 with the subsequent engagement of the connector contacts with the edge connector pads, following insertion, as illustrated in FIG. 22.

FIG. 31 illustrates an alternative embodiment of assemblies for 90A and 90B for application in various embodiments of the present invention. With reference to FIG. 31, the assembly 111 comprises a flexible dielectric 112 carrying a parallel spaced plurality of conductors 113 (3 only being shown in full with the remainder being shown in part only). The spring means is here integrated with the conductors in the form of beryllium-copper conductors 114 to provide resilient connection to the edge connector pads of a circuit board. The beryllium-copper conductors also provide resilient bias of the assembly into contact with a surface mount portion of a circuit board. The resilient conductor portions 114 and 115 are separated by a relatively flexible loop 116 of the dielectric material on which conductors interconnecting portions 114 and 115 are formed in a somewhat more flexible form than the spring conductors in the portions 114 and 115 thereby to facilitate the self-aligning requirements of the assembly for use in the connector of the present invention. The dielectric and conductors of the construction illustrated in FIG. 31 are designed to provide, in an integrated assembly, a combination of the resilience of the spring means of the previously described embodiments while at the same time providing the flexible circuit conductor provisions of those embodiments. In this construction the flexible dielectric 112 carries, on the surface thereof opposite the conductors 113, metal structures 117 which provide the alignment features, in this case of the third embodiment of the invention, and the strain relief interconnection of the assembly with the housing of the connector by connection with the mounting pins 42 while still providing for the desired float of the assembly to provide the self aligning feature of the invention. The metal structures 117 may be formed by deposition or made fast to the dielectric material by any other means well known to those skilled in the art.

Additionally, the metal structures 117 provide any required lateral stiffness of the structure to ensure the required specific spacing of conductors 113 laterally of the assembly. It will be appreciated by those skilled in the art that the structures 117 are not necessarily made of metal but could be made of any suitable material providing the desired structural requirements are met.

FIGS. 32 and 33 illustrate a further form of assembly for use in the present invention in which a conductor carrying a flexible circuit 117 is fast with a spring means 118 to provide the unitary structure suitable for use in the fourth embodiment (in this particular instance) of the present invention. The unitary construction may be produced by ultrasonic welding, the use of an adhesive, or the direct formation of the conductors and/or the spring means onto the dielectric by means of deposition etc. to form the unitary structure.

The basic difference between the assemblies illustrated in FIGS. 31, 32, and 33 relative to the first, second, third and fourth embodiments of the invention is the combination of the spring means with the flex circuit to provide a unitary structure.

It will be appreciated that while the embodiments of the present invention have been described utilizing a pair of flexible circuits suitable for communication with contact pads of both faces of a PC board or with two parallel rows of pads on one face of a PC board, the invention is applicable for use with a single spring means/flexible circuit arrangement for communicating with a single row of contact pads of a PC board.

It will be further appreciated that while the embodiments of the present invention have described the use of a single arch spring a spring with more than one raised feature, say a tandem arch will allow the connection to more than one set of conductors. This is of particular importance, as the use of a PTH flexible circuit with say, two rows of contact backed with a tandem spring will double the density of the connector.

It will be further appreciated that while the embodiments of the present invention have described the use of a single arch multiple leaf spring designed to achieve the desires force and compliance, it should be noted that a solid spring may also be used. To achieve the desired compliance a compression cushion between the circuit and the spring may be provided.

It will also be appreciated that while the spring means of the second embodiment is described and illustrated as involving first and second separate spring structures, the concepts of the present invention encompass an arrangement in which the first and second spring structures are combined into a single structure performing the functions of both the first and second spring structures described. In applications where conductors have a minimum center to center spacing of at least 25 mils the first and second spring structures may conveniently be combined into such a single spring structure.

It will also be appreciated that which the invention has been described with reference to a single row of pads on a face of a circuit, the invention is applicable to connection to more than one row of pads on the same face of the circuit. As used herein "pads" shall be construed to include exposed conductors to which electrical connection is desired.

In place of the screw mounting arrangements described with reference to the second embodiment the connector may be clamped or supported to the face of the printed circuit board by a wire lock arrangement which is pivotably supported in the housing of the connector and which may be pivoted into engagement with the circuit board, or which may include spring wire features to extend into openings in the circuit board concerned.

It is also envisaged that adjustment of contact producing pressure may be provided by a sliding or other cam or wedge movement to increase contact producing pressure when desired e.g. after insertion of the edge connector portion of a circuit board.

The contacts of the flexible circuit may be etched or stamped from a spring material or built from round spring wire. This approach eliminates the need for an individual spring, stores and applies the necessary contact pressure on demand, provides a wiping contact, compensates for variations in PC board thickness, and the dielectric provides required insulating material and stabilizes individual contacts insuring they maintain their spaced relationship.

The leading edge of the flexible circuits may be provided with retaining holes which are located by molded in posts. This approach is appropriate with highly flexible circuits. The retaining holes are sized to allow sufficient lateral movement as is necessary to align the circuit/spring while preventing the circuit from buckling during PCB insertion.

I claim:

1. A connector for electrically conductive connection to electrically conductive contact pads of a circuit comprising:

a) a housing;

b) a resilient flexible circuit assembly held captive by said housing, housed, at least in part, in said housing and having a flexible circuit with an end portion defining a row of conductive contact areas on one face thereof corresponding to said row of pads, resilient spring means for resiliently urging said areas into electrically conductive contact with said pads when said connector is attached at a desired location to said circuit;

c) means for providing limited desired float of said assembly in said housing to facilitate registration of said areas and said pads; and d) said assembly having alignment means to engage a cooperating feature of said circuit to cause registration of said areas with said pads, when said connector is attached at the desired location to said circuit, with sufficient accuracy to ensure that only the desired conductive contact between said areas and said pads is achieved.

2. A connector according to claim 1 wherein a) said connector is for connection to an edge portion, of said circuit, having opposed faces each carrying a row of said contact pads;

b) said housing houses a separate said resilient flexible circuit assembly associated with each said row of pads;

c) said float providing means provides said limited desired float for each said assembly; and d) each said assembly is located, releasably constrained and resiliently urged in the same said manner.

3. A connector according to claim 1 wherein said alignment means comprises openings in said assembly to encompass pins in said housing with sufficient clearance to allow the desired float.

4. A connector according to claim 1 wherein said assembly comprises separate flexible circuit and spring means together with means releasably constraining said flexible circuit in alignment with said spring means while permitting said limited desired float, said spring means resiliently urging said areas into electrically conductive contact with said pads when said connector is attached to a desired location to said circuit.

5. A connector according to claim 4 wherein alignment of said spring means and said flexible circuit is achieved by portions of said spring means arranged to engage openings in said flexible circuit.

6. A connector according to claim 4 wherein said alignment means comprise resilient projections of said spring means arranged to cooperate with said flexible circuit to releasable constrain said flexible circuit at least in a direction parallel to the length of said row of pads when said edge is inserted in said opening and to cooperate with an alignment feature of said circuit to ensure said registration.

7. A connector according to claim 6 wherein said projections provide said alignment while permitting pressure applied by said arched portion to be avoided except when registration has been achieved.

8. A connector according to claim 4 wherein a) said spring means includes a first plurality of interconnected parallel leaf springs each having an arched feature to provide said resilient urging, each leaf spring corresponding to at least one said area;

b) said housing has an opening for locating and receiving an edge portion of said circuit carrying said contact pads in a row extending along said edge portion and said contact areas electrically conductively contact said pads when said edge portion is inserted in said opening;

c) said first plurality of leaf springs are housed in said housing and said spring means includes a second plurality of parallel leaf springs which extend from said housing each corresponding to at least one contact area of said flexible circuit;

d) said flexible circuit extends from said housing with desired said contact areas positioned to be resiliently urged by said second plurality of leaf springs into contact with a row of conductive contacts on a face of a printed circuit board, when said connector is attached to said printed circuit board at a location where said contact areas overly said conductive contacts, thereby to facilitate electrically conductive connection between corresponding conductive contacts and contact pads by way of direct connection with said circuit areas; and comprising e) means for attaching said housing to a said printed circuit board at such a location; wherein f) said portion of said flexible circuit extending from said housing is releasably constrained in alignment with said spring means by further alignment means of said spring means, said further alignment means engaging a cooperating feature of said printed circuit board to register said areas with said conductive contacts, when said connector is mounted to said printed circuit board at said location, with sufficient accuracy to ensure that only the desired conductive contact between said areas and said conductive contacts is achieved.

9. A connector according to claim 8 wherein a) said printed circuit board includes two rows of said conductive contacts and a separate spring means is associated with each said row of conductive contacts;

b) each said spring means includes a second plurality of parallel leaf springs each having an arched portion and each corresponding to at least one said contact area;

c) a separate said flexible circuit is provided for each said row of conductive contacts, each flexible circuit being located, releasably constrained and resiliently urged in the same said manner d) the leaf springs of the second pluralities of parallel springs extending in opposite directions from said housing generally normal to the direction of reception of said edge portion into said opening and each second plurality of parallel springs being positioned to urge desired contact areas into contact with associated said conductive contacts when said connector is attached to said printed contact board with said contact areas overlying said conductive contacts.

10. A connector according to claim 8 wherein said further alignment means cooperate with said circuit board to permit pressure applied by said arched portions to be avoided except when registration has been achieved.

11. A connector according to claim 8 wherein said alignment means comprise end portions of said leaf springs arranged to engage openings in said flexible circuit to releasable constrain said flexible circuit laterally of the leaf springs.

12. A connector according to claim 1 wherein said assembly is a unitary structure.

13. A connector according to claim 12 wherein said conductive contact areas provide said resilient urging.

14. A connector according to claim 1 wherein said assembly is moveable, in said housing, between a first position facilitating insertion of said pads into the connector and a second position in which said areas and said pads are resiliently urged into said conductive contact.

15. A connector according to claim 14 wherein said assembly comprises a flexible circuit, a spring means affixed to said flexible circuit for movement therewith and pivot means facilitating pivotal movement of said assembly between said first and second positions.

16. A connector according to claim 15, wherein said pivot means comprises a curved member, attached to said assembly, supported by a curved feature of said housing configured to permit said float and said pivotal movement while retaining said assembly in said housing.

17. A connector according to claim 14 comprising means for moving said assembly from said first to said second position.

18. A connector according to claim 17 wherein said moving means is a cam.

19. A connector according to claim 18 wherein said cam has at one of a flat cam locating step, a progressive contour, an elliptical profile and sequentially functioning profiles.

* * * * *